US006310344B1

(12) United States Patent
Shin et al.

(10) Patent No.: US 6,310,344 B1
(45) Date of Patent: Oct. 30, 2001

(54) WIRE TYPE CORONA CHARGER FOR ELECTROPHOTOGRAPHICAL MANUFACTURING OF CRTS

(75) Inventors: Dong Ky Shin; Hyo Sup Lee; Sang Youl Yoon; Sang Bong Kwon, all of Gumi-si; Cheon Su Kang, Kimcheon-si; Myung Hwan Oh, Seoul; Kwang Duk Ahn, Seoul; Tae Suk Park, Seoul; Chong Hong Pyun, Seoul; Byung Yong Yu, Seoul, all of (KR)

(73) Assignees: Orion Electric Co., Ltd., Kyungsangbuk-do; Korea Institute of Science and Technology, Seoul, both of (KR)

( * ) Notice: Subject to any disclaimer, the term of this patent is extended or adjusted under 35 U.S.C. 154(b) by 0 days.

(21) Appl. No.: 09/297,208

(22) PCT Filed: Nov. 29, 1997

(86) PCT No.: PCT/KR97/00250

§ 371 Date: Apr. 27, 1999

§ 102(e) Date: Apr. 27, 1999

(87) PCT Pub. No.: WO99/12181

PCT Pub. Date: Mar. 11, 1999

(30) Foreign Application Priority Data

Aug. 30, 1997 (KR) ..... 97-43624

(51) Int. Cl.[7] ..... H01T 19/00

(52) U.S. Cl. ..... 250/326; 361/229; 361/230

(58) Field of Search ..... 250/324, 325, 250/326; 361/229, 230

(56) References Cited

U.S. PATENT DOCUMENTS

| | | | | |
|---|---|---|---|---|
| 4,203,144 | * | 5/1980 | Okamoto | 250/324 |
| 4,386,837 | * | 6/1983 | Ando | 250/325 |
| 4,652,754 | * | 3/1987 | Almeter et al. | 250/325 |
| 5,132,188 | * | 7/1992 | Datta et al. | 250/325 |
| 5,324,942 | * | 6/1994 | Mishra | 250/326 |
| 5,519,217 | * | 5/1996 | Wilbur, Jr. et al. | 250/326 |

* cited by examiner

*Primary Examiner*—Jack Berman
(74) *Attorney, Agent, or Firm*—Nataro & Michalos P.C.

(57) ABSTRACT

Disclosed is a wire-type corona charger having a wire electrode disposed between ground electrode plates. The wire electrode is supported by the ends of the plurality of wire electrode supporters which are so arranged that their ends have a curvature equal to arcuately-shaped upper edge of the ground electrode plates. The curvature coincides with one of the curvatures of the horizontal axis and the vertical axis of the interior surface of the panel faceplate, while the charger is pivoted along the other curvature of the faceplate. The charger can uniformly charge the photoconductive layer and improves the charging efficiency.

26 Claims, 12 Drawing Sheets

34
32
18

36
34
32
18

35
35'
16a
16
34
32
18

18
32
34
35''

21
34
32
18

WIRE TYPE CORONA CHARGER FOR ELECTROPHOTOGRAPHICAL MANUFACTURING OF CRTS

FIELD OF THE INVENTION

The present invention relates to a wire-type corona charger for electrophotographically manufacturing a screen of a CRT, and more particularly to a wire-type corona charger and a method using the charger for electrophotographically manufacturing a screen of a CRT, in which the photoconductive layer can be uniformly charged by a wire electrode.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, and electron gun 11 centrally mounted within the neck 14, and a shadow mask 16 removably mounted to a sidewall of the panel 12. A three-color phosphor screen is formed on the inner surface of a display window or faceplate 18 of the panel 12.

The electron gun 11 generates three electron beams 19*a,* or 19*b,* said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, which is formed on the rear surface of the faceplate 18, comprises an array of three phosphor elements R, G and B of three different emission colors arranged in a cyclic order of a predetermined structure of multiple-stripe or multiple-dot shape and a matrix of light absorptive material surrounding the phosphor elements R, G and B, as shown in FIG. 2.

A thin film of aluminum 22 or an electro-conductive layer, overlying the screen 20 in order to provide a means for applying the uniform potential applied through the anode button 15 to the screen 20, increases the brightness of the phosphor screen and prevents ions in the phosphor screen from being lost and the potential of the phosphor screen from decreasing. And also, a film of resin 22'such as lacquer (not shown) may be applied between the aluminum thin film 22 and the phosphor screen 20, so as to enhance the flatness and reflectivity of the aluminum thin film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby requiring high cost in manufacturing the phosphor screen. In addition, it discharges a large quantity of effluent such as waste water, phosphor elements, 6th chrome sensitizer, etc., with the use of a large quantity of clean water.

To solve or alleviate the above problems, the improved process of electrophotographically manufacturing the screen utilizing dry-powdered phosphor particles is developed.

U.S. Pat. No. 4,921,767, issued to Datta at al. on May 1, 1990, discloses one method of electrophotographically manufacturing the phosphor screen assembly using dry-powdered phosphor particles through a series of steps represented in FIGS. 3A to 3E, as is briefly explained in the following.

After the panel 12 is washed, an electro-conductive layer 32 is coated on the faceplate 18 of the panel 12 and the photoconductive layer 34 is coated thereon, as shown in FIG. 3A. Conventionally, the electro-conductive layer 32 is made from an inorganic conductive material such as tin oxide or indium oxide, or their mixture, and preferably, from a volatilizable organic conductive material such as a polyelectrolyte commercially known as polybrene (1,5,-dimethyl-1,5-diaza-undecamethylene polymethobromide, hexadimethrine bromide), available from Aldrich Chemical Wisc., or another quaternary ammonium salt.

The polybrene is applied to the inner surface of the faceplate 18 in an aqueous solution containing about 10 percent by weight of propanol and bout 10 percent by weight of a water-soluble adhesion-promoting polymer (poly vinyl alcohol, polyacrylic acid, polyamides and the like), and the coated solution is dried to form the conductive layer 32 having a thickness from about 1 to 2 microns and a surface resistivity of less than about $10^8$ l (ohms per square unit).

The photoconductive layer 34 is formed by coating the conductive layer 32 with a photoconductive solution comprising a volatilizable organic polymeric material, a suitable photoconductive dye and a solvent. The polymeric material is an organic polymer such as polyvinyl carboazole, or an organic monomer such as n-ehtyl carbazole, n-vinyl carbazole or tetraphenylbutatriene dissolved in a polymeric binder such as polymethylpolypropylene carbonate. The photoconductive composition contains from about 0.1 to 0.4 percent by weight such dyes as crystal violet, chloridine blue, rhodamine EG and the like, which are sensitive to the visible rays, preferably rays having wavelength of from about 400 to 700 nm. The solvent for the photoconductive composition is an organic such as chlorobenzene or cyclopentanone and the like which will produce as little cross contamination as possible between the layers 32 and 34. The photoconductive layer 32 is formed to have a thickness from about 2 to 6 microns.

FIG. 3B schematically illustrates a charging step, wherein the photoconductive layer 34 overlying the electro-conductive layer 32 is positively charged in a dark environment by a conventional positive corona discharger 36. As shown, the charger or charging electrode of the discharger 36 is positively applied with direct current while the negative electrode of the discharger 36 is connected to the electro-conductive layer 32 and grounded. The charging electrode of the discharger 36 travels across the layer 34 and charges it with a positive voltage in the range from −200 to +700 volt.

FIG. 3C schematically shows an exposure step, wherein the charged photoconductive layer 34 is exposed through a shadow mask 16 by a xenon flash lamp 35 having a lens system 35' in the dark environment. In this step, the shadow mask 16 is installed on the panel 12 and the electro-conductive layer 32 is grounded. When the xenon flash lamp 35 is switched on to shed light on the charged photoconductive layer 34 through the lens system' and the shadow mask 16, portions of the photoconductive layer 34 corresponding to apertures or slits 16*a* of the shadow mask 16 are exposed to the light. Then, the positive charges of the exposed areas are discharged through the grounded conductive layer 32 and the charges of the unexposed areas remain in the photoconductive layer 34, thus establishing a latent charge image in a predetermined array structure, as shown in FIG. 3C. In order to exactly form light-absorptive matrices, it is preferred that the xenon flash lamp 35 travels along three positions while coinciding with three different incident angles of the three electron beams.

FIG. 3D schematically shows a developing step which utilized a developing container 35" containing dry-powdered light-absorptive or phosphor particles and carrier beads for producing static electricity by coming into contact with the dry-powdered particles. Preferably, the carrier beads are so mixed as to charge the light-absorptive particles with negative electric charges and the phosphor powders with positive electric charges, when they come into contact with the dry-powdered particles.

In this step, the panel 12, from which the shadow mask 16 is removed, is put on the developing container 35' containing the dry-powdered particles, so that the photoconductive layer 34 can come into contact with the dry-powdered particles. In this case, the negatively charged light-absorptive particles are attached to the positively charged unexposed areas of the photoconductive layer 34 by electric attraction, while the positively charged phosphor particles are repulsed by the positively charged unexposed areas but attached by reversal developing to the exposed areas of the photoconductive layer 34 from which the positive electric charges are discharged.

FIG. 3E schematically represents a fixing step by means of infrared radiation. In this step, the light-absorptive and phosphor particles attached in the above developing step are fixed together and onto the photoconductive layer 14. Therefore, the dry-powdered particles include proper polymer components which may be melted by heat and have proper adhesion.

Where the surface of the panel is flat, a conventional linear corona charger, such as those shown and described in U.S. Pat. Nos. 3,475,169, 3,515,548, and 4,386,837 issued respectively on Oct. 28, 1969, Jun. 2, 1970, and Jun. 7, 1983, can be used in the above-described charging step shown in FIG. 3B. However, where the interior surface contour of the faceplate panel is non-planar or has a certain curvature as the usual panel, the conventional linear charger will not uniformly charge the photoconductive layer and may generate deleterious arcs because the spacing between the charger and the photoconductive layer cannot be maintained uniformly.

To overcome the above problems, U.S. Pat. No. 5,132,188 discloses another corona discharge apparatus 36 having a corona charger 50 as shown in FIGS. 4 and 5.

Referring to FIG. 4, the corona discharge apparatus 36 includes a housing 38 having a faceplate panel support surface 40. A faceplate panel 12 having a conductive layer 32 and a photoconductive layer 34 coated thereon, is placed upon the support surface 40 and positioned by a plurality of panel alignment members 42, which engage the outer surface of the panel sidewall. An electrical ground contact 44, attached at one end of the housing 38, is spring biased to contact the conductive layer 32. A corona generator 46 is disposed within the housing 38. The generator 46 includes a high voltage power supply 48, which provides a corona voltage to a corona charger 50. The corona charger 50 is pivotally attached, at the center of curvature of the faceplate 12, by means of a support arm 52 to a support bar 54. The support arm 52 is connected to a motor 56 by a reciprocating drive screw 58, which causes the corona charger 50 to make multiple passes across the faceplate panel 12. The ultimate charge on the photoconductive layer 34 is determined by the number of passes across the panel which, in turn, is controlled by a timer 60 which communicates with a motor controller 62 and the high voltage power supply 48. The charging sequence is initiated from a control panel 64. An electrostatic voltage probe 84, coupled to a voltmeter 86 on the control panel 64, measures the voltage on the layer 34 at the end of the charging cycle. A probe driver 83 moves the probe 84 into proximity with the charged photoconductive layer 34.

While only one corona charger 50 is shown in FIG. 4, multiple chargers may be used.

The corona charger 50 is shown in FIG. 5. The corona charger comprises an arcuately-shaped ground electrode 66 having two parallel sides 68 and an interconnecting base 70, which form a U-shaped conductor. The sides 68 terminate in edges 72 that are rounded to suppress arcs during operation. A foil charging electrode 74 is supported, by means of an insulator 76, between the sides 68 and the base 70 of the ground electrode. The charging electrode 74 also is arcuately-shaped and, preferably, has a substantially arcuately-contoured edge 78 with a plurality of pin-type projections 80 extending therefrom. The arcuately-contoured edge 78 and sides 68 are coincident with the curvature of one axis, for example the minor axis, of the interior surface of the faceplate panel 12. The length of the support arm 52 is adjusted so that the center of curvature of the arc of the charger 50 coincides with the center of curvature of one of the axes of the panel interior surface.

In the means time, U.S. Pat. No. 5,519,217 issued to Wilbur, Jr. et al., on May 21, 1996, discloses a charging apparatus having a plurality of electrodes or blades installed on a base over the entire interior surface of the faceplate 18, detailed depiction of which is omitted in the attached drawings. In the apparatus, the focusing blades correspond to the above ground electrode, and the charging blades are disposed respectively between the adjacent focusing blades and have a plurality of serration formed at the ends thereof. The charging head moves laterally within the faceplate panel by a distance substantially equal to the periodic spacing between the charging blades, thereby providing a substantially uniform electrostatic charge to the photoconductive layer on the faceplate. Therefore, the apparatus greatly increases the charging speed or shortens the charging time without jeopardizing the uniformity of the charge applied to the photoconductive layer, thereby greatly enhancing capability in mass production.

In order to achieve uniform exposing and developing in the steps shown in FIGS. 3C and 3D, it is preferred that the photoconductive layer 34 may be uniformly charged. Further, the charging electrodes and the photoconductive layer 34 must be prevented from being damaged by arc or spark therebetween. Therefore, the above-mentioned apparatuses employ arcuately-shaped thin plates as electrodes for charging, each of the plates having a plurality of pin-type projections 80 or serration, so as to provide a stable and uniform electrostatic charge to the photoconductive layer by means of desired corona charging.

Still, it is not easy for the pin-type projections 80 or serration to cause a uniform corona discharge due to their inherent shapes. That is, the greatest discharge is generated at the distal end of each projection or each tooth of the serration, while the intensity of discharge decreases as it goes far from the distal end. This problematic discharge causes multiform exposing and developing the above exposing and developing steps, thereby forming phosphor elements multiformly even in a desired array.

Meanwhile, it is well known in the art that a wire-type corona charger generates stable and highly uniform corona discharge and exhibits superior charging efficiency relative to other types of electrodes. However, because the interior surface of the panel 12 is spheric, and moreover because the larger cathode ray tube has the more complex aspheric panel surface in which the curvature of the horizontal section is larger than that of the vertical section, it is not easy for the wire electrodes to coincide with such complex curvatures.

The present invention has been made to overcome the above described problems, and therefore ti is an object of the present invention to provide a wire-type corona charger for electrophotographically manufacturing a screen of a CRT, which can uniformly charge the photoconductive layer by generating corona discharge through wire electrodes.

It is another object of the present invention to provide a method for electrophotographically manufacturing a screen of a CRT using the wire-type corona charger.

SUMMARY OF THE INVENTION

To achieve the above objects, the present invention provides a wire-type corona charger for electrophotographically manufacturing a screen of a CRT, the wire-type corona charger being installed in a corona discharge apparatus and pivoted with a spacing over an entire interior surface of a panel faceplate of the screen along a first curvature which is one of curvatures of a horizontal axis and a vertical axis of the interior surface of the panel faceplate, so as to uniformly charge at least effective surface of a photoconductive layer with a desired voltage, the photoconductive layer being formed on an electro-conductive layer formed on the interior surface of the panel faceplate, the wire-type corona charger comprising:

a pair of ground electrode plates each of which has arcuately-shaped upper edge with a curvature substantially equal to a second curvature, the second curvature being a remaining one of the curvatures of the horizontal axis and the vertical axis of the interior surface of the panel faceplate, the pair of ground electrode plates being grounded with being arranged in parallel and spaced with regular intervals apart;

an insulating block disposed between the pair of the ground electrode plates and made from electrically insulating material, the insulating block having a plurality of wire electrode supporters so arranged that their upper ends are arranged to have a curvature substantially equal to the second curvature and lower than upper edges of the repair of ground electrode plates; and a wire electrode being supported by the ends of the plurality of wire electrode supporters, to which a high voltage is applied, so that at least effective screen of the photoconductive layer is charged uniformly, the electro-conductive layer serving as an opposed electrode of the wire electrode.

In accordance with another aspect of the present invention, another wire-type corona charger may be installed in a corona discharge apparatus and pivoted to a predetermined distance along a first curvature which is one of curvatures of a horizontal axis of a vertical axis of the interior surface of the panel faceplate, so as to uniformly charge at least effective surface of a photoconductive layer with a desired voltage, the photoconductive layer being formed on an electro-conductive layer formed on the interior surface of the panel faceplate, the wire-type corona charger being pivoted with a spacing from the photoconductive layer, the wire-type corona charger comprising:

at least three ground electrode plates, each of which has arcuately-shaped upper edge with a curvature substantially equal to a second curvature, the second curvature being a remaining one of the curvatures of the horizontal axis and the vertical axis of the interior surface of the panel faceplate at each section of the panel faceplate nearest to each of the ground electrodes, the pair of ground electrode plates being grounded with being arranged in parallel and spaced with regular intervals apart;

at least two sets of insulating blocks each of which is disposed respectively between the ground electrode plates and made from electrically insulating material, each of the insulating blocks having a plurality of wire electrode supporters so arranged that their upper ends are arranged to have a curvature substantially equal to the second curvature; and at least two wire electrodes being supported by the upper ends of the wire electrode supporters, to which a high voltage is applied, so that at least effective screen of the photoconductive layer is charged uniformly, the electro-conductive layer serving as an opposed electrode of the wire electrodes.

The present invention also provides a method for electrophotographically manufacturing a screen of a CRT, the method comprising the steps of:

(1) firstly coating an inner surface of a panel faceplate to form a volatile conductive layer on the inner surface;

(2) secondly coating the volatile conductive layer with a photoconductive solution to form a volatile photoconductive layer on the volatile conductive layer, the photoconductive solution not contaminating the volatile conductive layer;

(3) charging at least effective surface of the volatile photoconductive layer with uniform electrostatic charges by pivoting a wire-type corona charger along a first curvature corresponding to one of the curvatures of the horizontal axis and the vertical axis of an interior surface of the panel faceplate with a spacing over an entire interior surface of the panel faceplate, the corona charger generating a corona discharge;

(4) exposing the volatile photoconductive layer through a shadow mask to a light according to a characteristic of the volatile photoconductive layer, so as to selectively discharge the electrostatic charges having been charged on the volatile photoconductive layer in step 3; and (5) developing the photoconductive layer by attaching powdered particles on one of an exposed area and an unexposed area of the photoconductive layer after charging the powdered particles, the exposed area having been exposed to light in step 4 to lose the electrostatic charges, wherein the wire-type corona charger comprises:

a pair of ground electrode plates each of which has arcuately-shaped upper edge with a curvature substantially equal to a second curvature, the second curvature being a remaining one of the curvatures of the horizontal axis and the vertical axis of the interior surface of the panel faceplate, the pair of ground electrode plates being grounded with being arranged in parallel and spaced with regular intervals apart;

an insulating block disposed between the pair of the ground electrode plates and made from electrically insulating material, the insulating block having a plurality of wire electrode supporters so arranged that their upper ends are arranged to have a curvature substantially equal to the second curvature and lower than upper edges of the pair of ground electrode plates; and a wire electrode being supported by the ends of the plurality of wire electrode supporters, to which a high voltage is applied, so that at least effective screen of the photoconductive layer is charged uniformly, the electro-conductive layer serving as an opposed electrode of the wire electrode.

Another aspect of the present invention embodies in a method for electrophotographically manufacturing a screen of a CRT, the method comprising the steps of:

(1) firstly coating an inner surface of a panel faceplate to form a volatile conductive layer on the inner surface;

(2) secondly coating the volatile conductive layer with a photoconductive solution to form a volatile photoconductive layer on the volatile conductive layer, the photoconductive solution not contaminating the volatile conductive layer;

(3) charging at least effective surface of the volatile photoconductive layer with uniform electrostatic charges by pivoting a wire-type corona charger along a first curvature corresponding to one of the curvatures of the horizontal axis and the vertical axis of an interior surface of the panel faceplate over an entire interior surface of the panel faceplate, the wire-type corona charger being pivoted with a spacing from the photoconductive layer, the wire-type corona charger generating a corona discharge;

(4) exposing the volatile photoconductive layer through a shadow mask to a light according to a characteristic of the volatile photoconductive layer, so as to selectively discharge the electrostatic charges having been charged on the volatile photoconductive layer in step 3; and (5) developing the photoconductive layer by attaching powdered particles on one of an exposed area and an unexposed are of the photoconductive layer after charging the powdered particles, the exposed area having been exposed to light in step 4 to lose the electrostatic charges, wherein the wire-type corona charger comprises:

at least three ground electrode plates, each of which has arcuately-shaped upper edge with a curvature substantially equal to a second curvature, the second curvature being a remaining one of the curvatures of the horizontal axis and the vertical axis of the interior surface of the panel faceplate at each section of the panel faceplate nearest to each of the ground electrodes, the pair of ground electrode plates being grounded with being arranged in parallel and spaced with regular intervals apart;

at least two sets of insulating blocks each of which is disposed respectively between the ground electrode plates and made from electrically insulating material, each of the insulating blocks having a plurality of wire electrode supporters so arranged that their upper ends are arranged to have a curvature substantially equal to the second curvature; and at least two wire electrodes being supported by the upper ends of the wire electrode supporters, to which a high voltage is applied, so that at least effective screen of the photoconductive layer is charged uniformly, the electro-conductive layer serving as an opposed electrode of the wire electrodes.

A wire-type corona charger and a method using the charger according to the present invention prevent generation of arc or spark and thereby enable the uniform charging by corona discharge on the photoconductive layer without damaging the photoconductive layer even at repetitive charging. Therefore, the present invention largely improves the efficiency of corona charging and as well makes the density or the thickness of the phosphor layer of the phosphor screen uniform.

BRIEF DESCRIPTION OF THE DRAWING

The above object, and other features and advantages of the present invention will become more apparent by describing in detail preferred embodiments thereof with reference to the attached drawings, in which.

DETAILED DESCRIPTION OF THE PREFERRED EMBODIMENTS

Hereinafter, several embodiments of the present invention will be described in detail with reference to the attached drawings.

Figure 6:
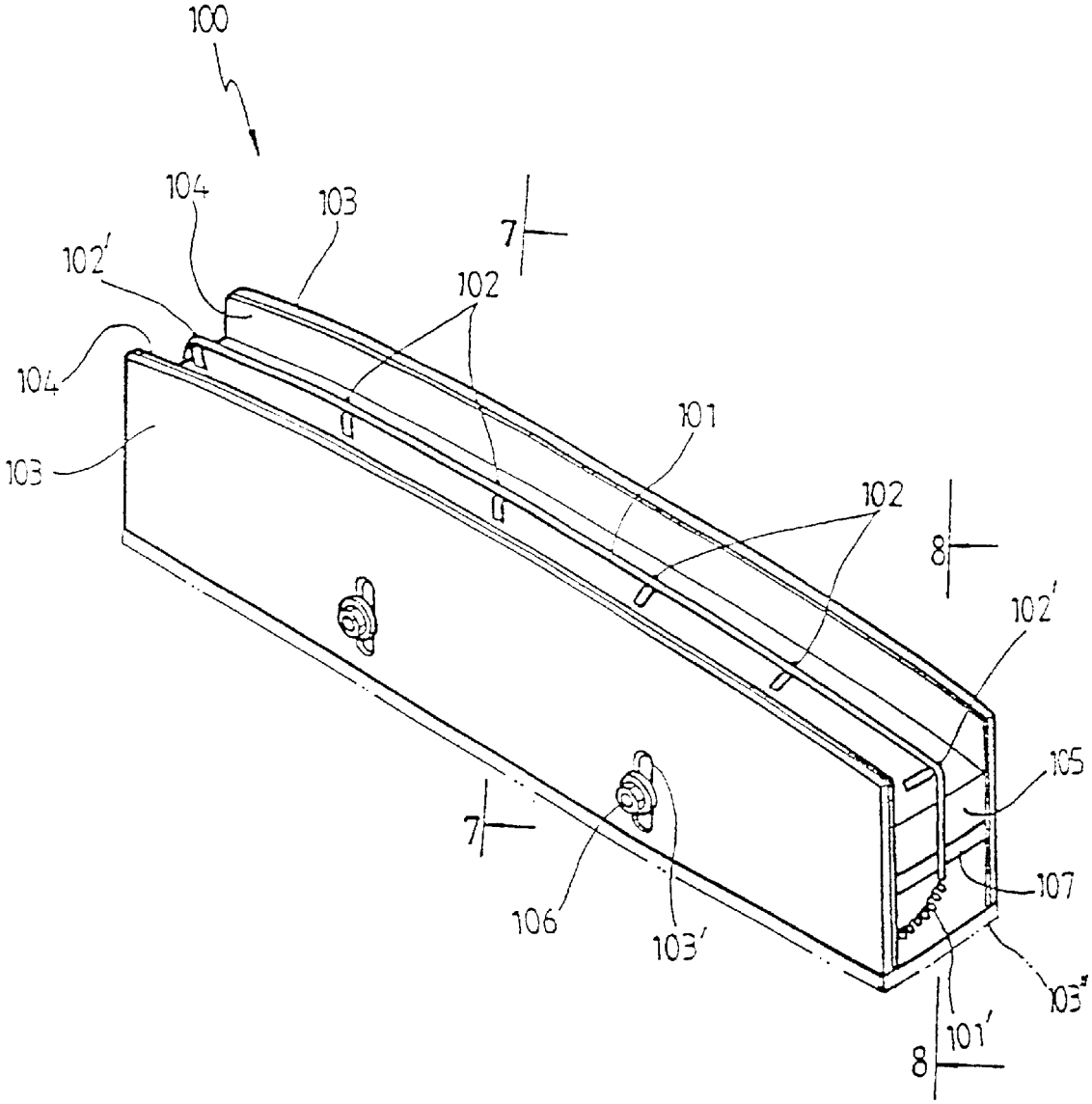
FIG. 6 is a perspective view of a wire-type corona charger for electrophotographically manufacturing a screen of a CRT according to one embodiment of the present invention.
Figure 7:
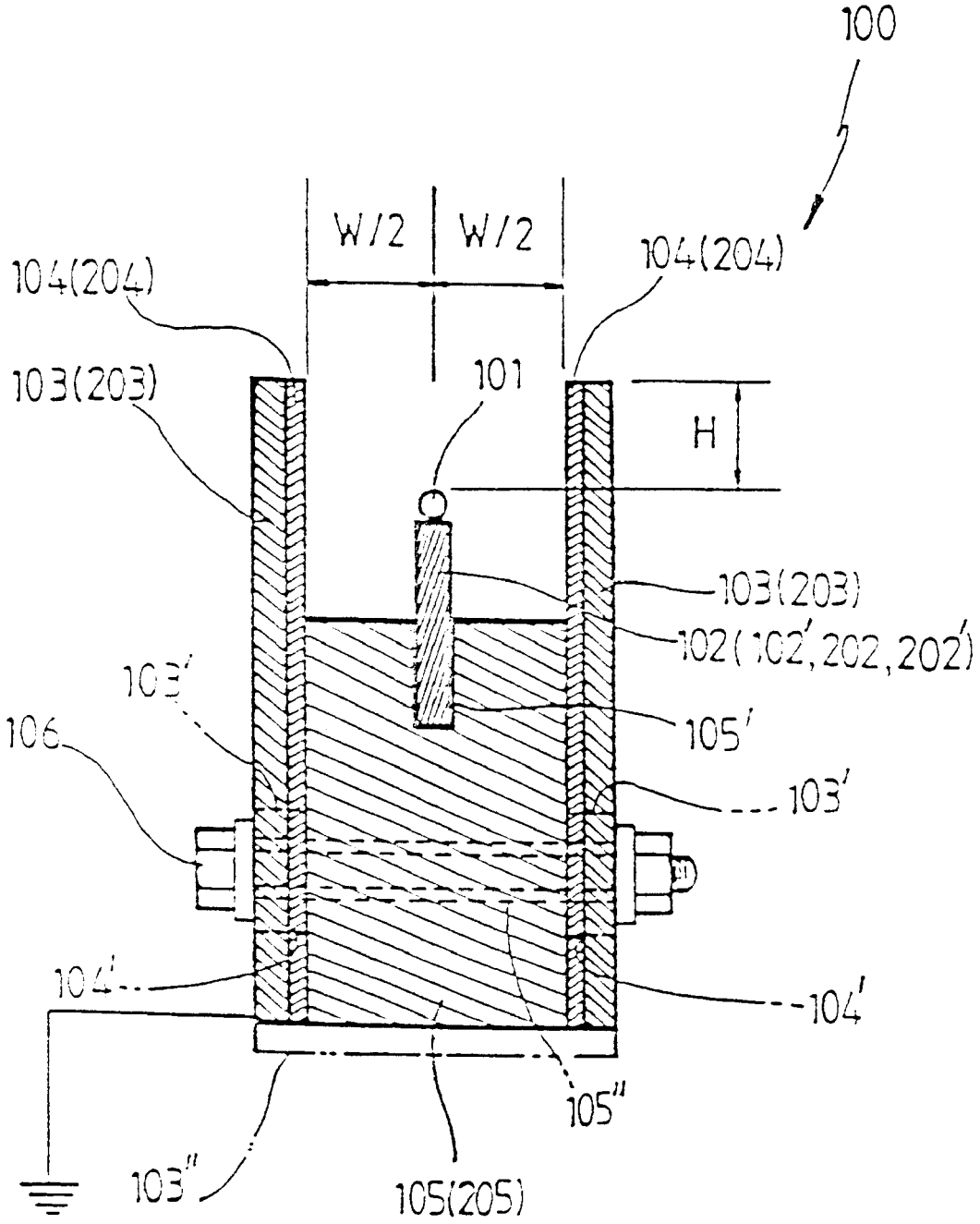
FIG. 7 is a sectional view taken along the line 7—7 in FIG. 6.
Figure 8:
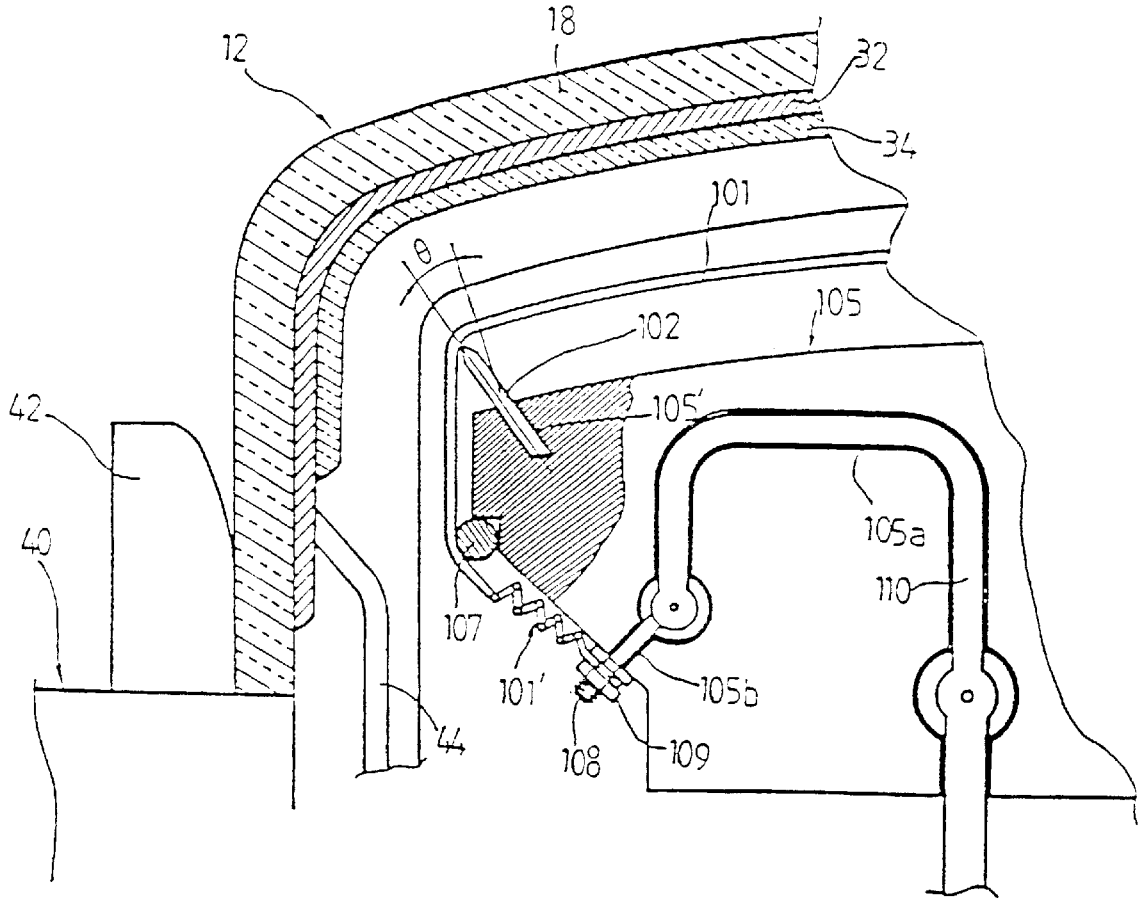
FIG. 8 is an enlarged partial section taken along the line 8—8 in FIG. 6.
Figure 9:
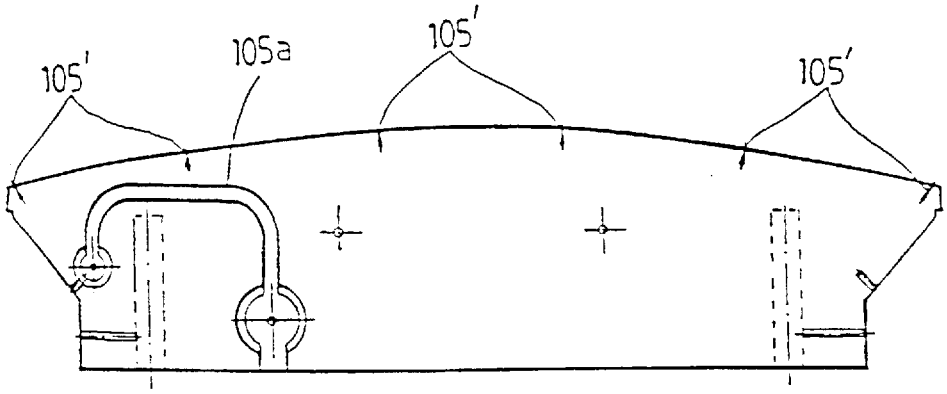
FIG. 9 is a front view of an insulating block employed in the wire-type corona charger of FIG. 6.
Figure 10:
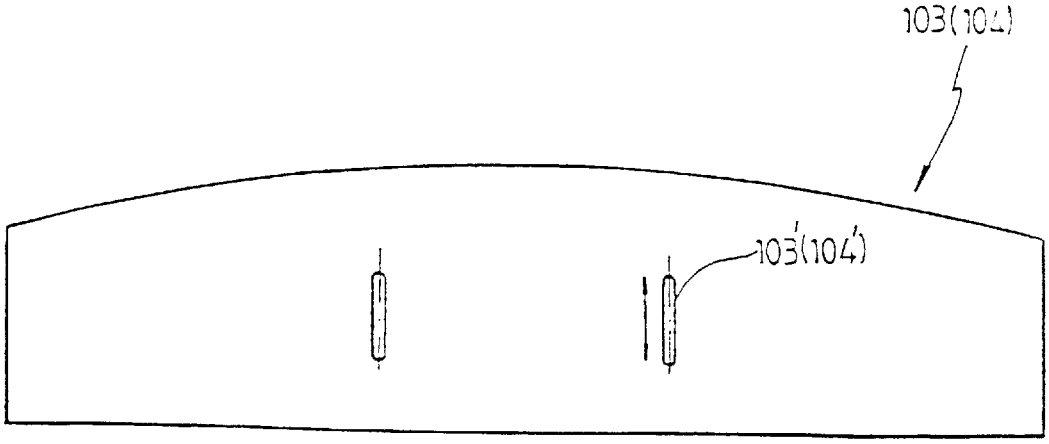
FIG. 10 is a front view of a ground electrode plate employed in the wire-type corona charger of FIG. 6.

FIG. 6 is a perspective view of a wire-type corona charger 100 for electrophotographically manufacturing a screen of a CRT according to one embodiment of the present invention, FIG. 7 is a sectional view taken along the line 7—7 in FIG. 6, and FIG. 8 is an enlarged partial section taken along the line 8—8 in FIG. 6. FIG. 9 is a front view of an insulating block 105 employed in the wire-type corona charger 100 of FIG. 6, and FIG. 10 is a front view of a ground electrode plate 103 employed in the wire-type corona charger 100 of FIG. 6.

Referring to FIGS. 6 to 8, the wire-type corona charger 100 according to the embodiment of the present invention comprises a pair of ground electrode plates 103, a wire electrode 101, a pair of ground electrode plates 103, and an insulating block 105.

Figure 4:
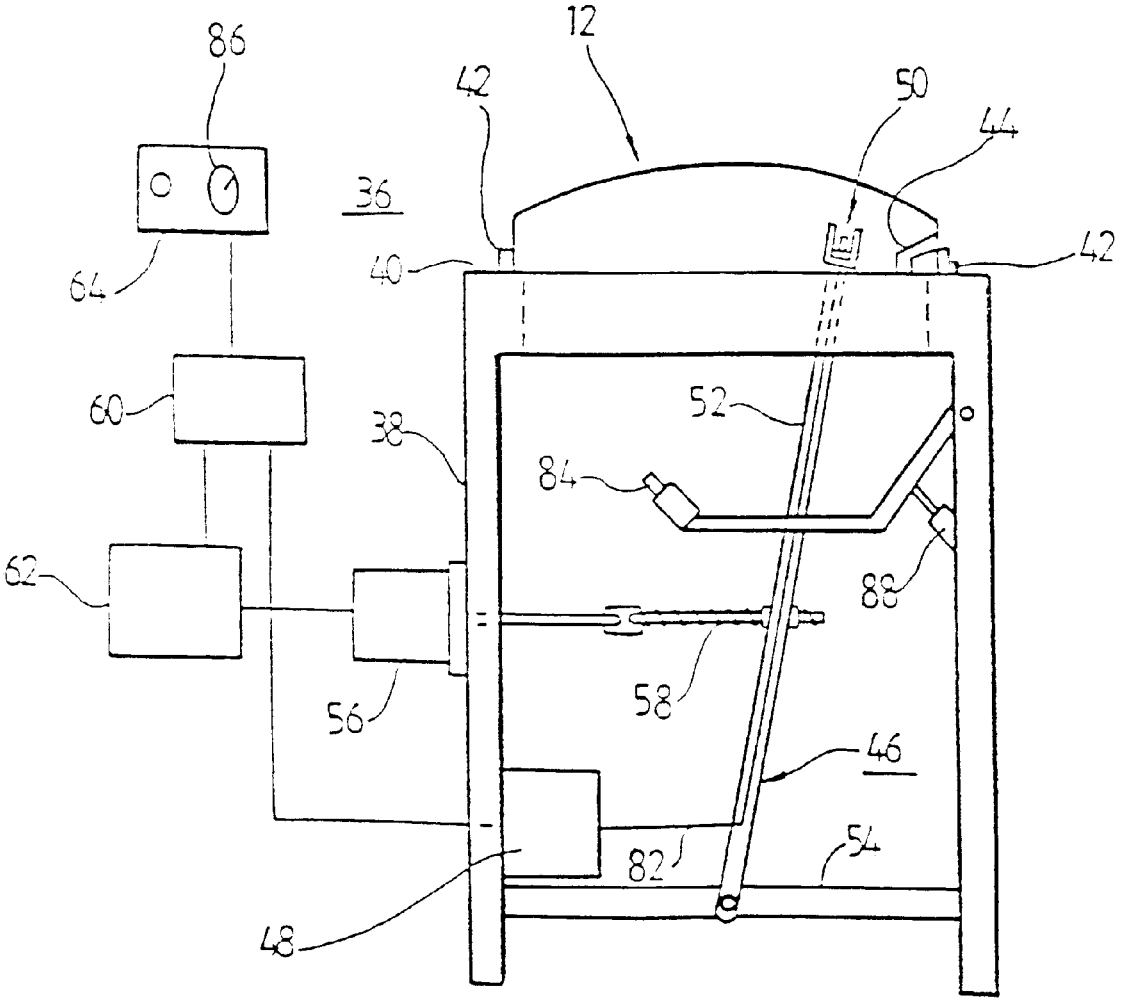
FIG. 4 is a schematic section of a conventional corona discharge apparatus.
Figure 5:
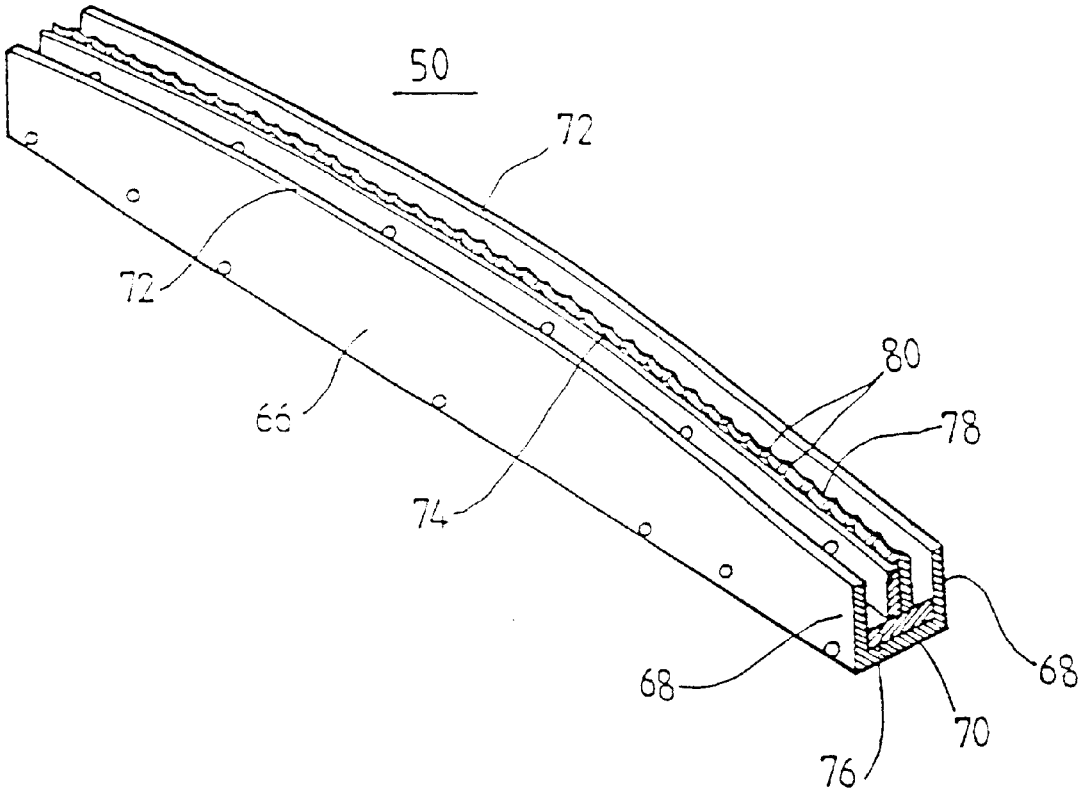
FIG. 5 is a perspective view of a conventional corona charger employed in the corona discharge apparatus of FIG. 5, the charging electrode of which has a plurality of pin-type projections.

The wire-type corona charger 100, installed in the corona discharge apparatus 36 of FIG. 4 instead of the corona charger 50, is pivoted along one of the curvatures of the horizontal axis and the vertical axis of the interior surface of the panel with spacings over the entire interior surface of the panel, so as to uniformly charge at least effective surface of the photoconductive layer with a desired voltage.

Each arcuately-shaped upper edge of the pair of ground electrode plates 103 has a curvature substantially equal to the remaining one of the curvatures of the horizontal axis and the vertical axis of the interior surface of the panel. In case where the interior surface of the faceplate 18 is aspheric, that is, the radiuses of the curvatures of the horizontal and vertical axes of the interior surface of the panel are different from each other, it is preferred that the above-mentioned remaining curvature has the longer radius, so as to enhance the uniformity of the charges and shortens the pivoting distance. Further, the pair of ground electrode plates 103 are arranged in parallel and spaced with regular intervals apart. The pair of ground electrode plates 103 may be grounded, or a predetermined voltage such as 1 KV may be applied to the pair of ground electrode plates 103, as is to the focusing blade of U.S. Pat. No. 5,519,217.

The insulating block 105 is disposed between the pair of the ground electrode plates 103 so as to insulate the pair of ground electrode plates 103 and the wire electrode 101. the insulating block 105 and the pair of ground electrode plates 103 may be detachably assembled by assembling means 106, as shown in FIG. 6. In this case, slots 103' may be formed in one of the insulating block 105 and the pair of ground electrode plates 103, so as to adjust the relative position of the wire electrode 101 and the distal edge of the ground electrode plates 103. In the meantime, the insulating block 105 may be inserted in and formed integrally with the pair of ground electrode plates 103 through injection molding without separate fixing means, differently from that shown in FIG. 6.

The insulating block 105 has a plurality of wire electrode supporters 102 and 102' which support the wire electrode 101 on their ends. The wire electrode supporters 102 and 102' are arranged so that their ends are positioned along a curvature substantially equal to the above remaining curvature and lower than upper edges of the pair of ground electrode plates 103. As shown in FIGS. 6 and 7, the wire electrode supporters 102 and 102' may be forcedly inserted in a supporter recess 105' formed on the upper surface of the insulating block 105. Otherwise, they may be inserted in the supporter recess 105' by means of adhesives, or fixed by melting after insertion, or formed integrally with the insulating block 105 by injection molding, etc.

As shown by two-dot-dashed line in FIG. 7, the pair of ground electrode plates 103 may be formed integrally with each other by a base 103". Also in this case, the insulating block 105 may be inserted onto the base 103" and then fixed by a fixing means including adhesives, or be formed integrally therewith. Preferably, the upper surface of the insulating block 105 as above may be so formed to prevent leakage of high voltage.

More preferably, the wire electrode supporters 102' disposed at the opposite ends among the wire electrode supporters 102 and 102' may support the wire electrode 101 in such a manner that even the peripheral portions of the effective viewing screen of the faceplate 18 can be uniformly charged. In case where the wire electrode supporters 102 and 102' are supported in the supporter recess 105' after being inserted thereinto, it is preferred that the upper surface of the insulating block 105 is formed to have a curvature substantially equal to the remaining curvature, and that the plurality of wire electrode supporters 102 excepting from those at the opposite ends extend in normal directions with respect to the curvature of the upper surface of the insulating block 105, while the wire electrode supporter 102' at the opposite ends extend to be open as widely as possible outward from the normal directions.

As apparent from the following description in relation to FIGS. 12 to 17, the value of the contact resistance due top the contact between the wire electrode 101 and the wire electrode supporters 102 and 102' has a large effect on the corona discharge. Therefore, required is a selection of material which exhibits high strength and mall current loss even with small contact area, in order to minimize the contact resistance. The present invention employs a material such as glass and ceramic, which not only shows the above characteristic but also has a high dielectric constant and durability, thereby further improving the uniformity of charge and the efficiency of corona charging. Furthermore, in order to achieve the same objects as above, the distal ends of the wire electrode supporters 102 and 102' may be formed sharply, e.g., their sections in the curvature direction may respectively have an inverted V-shape, so as to minimize the contact area between the wire electrode 101 and the wire electrode supporters 102 and 102', thereby minimizing the leakage of high voltage.

Therefore, the wire electrode 101 can have a desired curvature because it is supported on the distal ends of the wire electrode supporters 102 and 102' as constructed above. By applying high voltage to the wire electrode 101, at least effective screen of the photoconductive layer 34 can be charged uniformly as described later on.

In the meantime, the wire electrode 101 has a tension-applying means 101' for applying tension to the wire electrode 101. Referring to FIGS. 6 and 8, the tension-applying means 101' located at either ends of the insulating block 105 is formed integrally with the opposite ends of the wire electrode 101. The wire electrode 101 is supported on the insulating block 105 by means of tension-support means 107 at one point between the tension-applying means 101' and the wire electrode supporters 102'. Therefore, a constant tension is continuously applied to the wire electrode 101 along its entire length after the wire electrode 101 is installed, to thereby enable the uniform corona discharge along the entire length of the wire electrode 101.

Preferably, the wire electrode 101 may be made of tungsten plated with gold, to further improve the discharge efficiency.

In addition, the wire electrode 101 may be located lower than the distal edge of the pair of ground electrode plates 103 by a depth H corresponding to a half of the spacing W between the pair of ground electrode plates 103, and located at the middle of the spacing, thereby generating symmetric corona discharge to enable further uniform charging. In the tested wire electrode 101 whose testing result is shown in FIGS. 12 to 17, the spacing W is 12.8 mm and the depth H is 6 mm.

Figure 12:
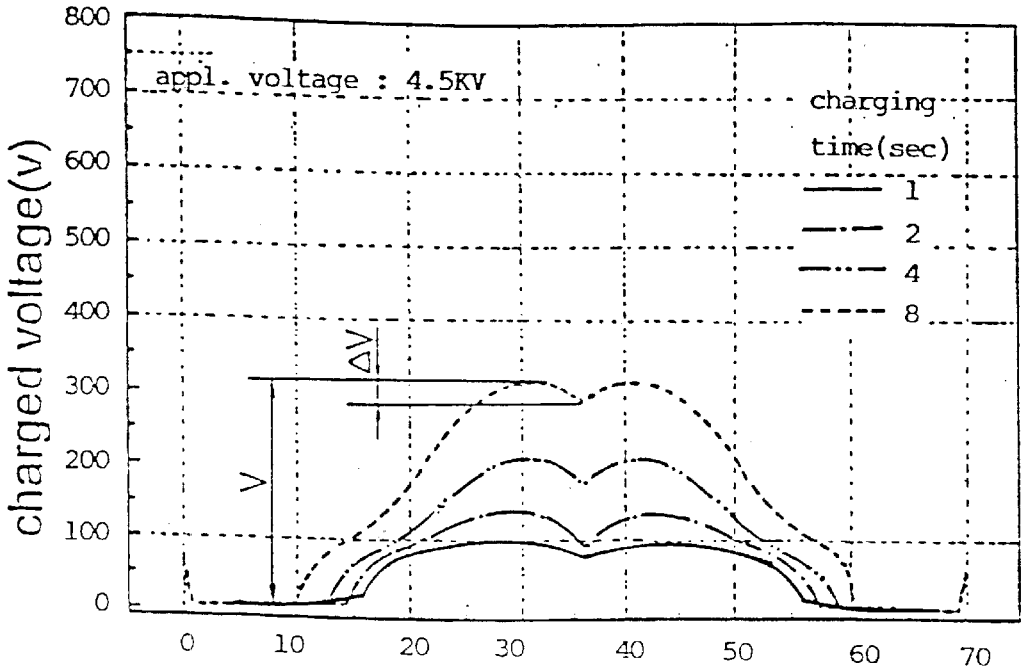
FIGS. 12 and 13 are graphs for showing distributions of the charged voltages according to the distance with respect to several charging times, respectively when 4.5 KV and 5 KV are applied to the wire-type corona charger.
Figure 13:
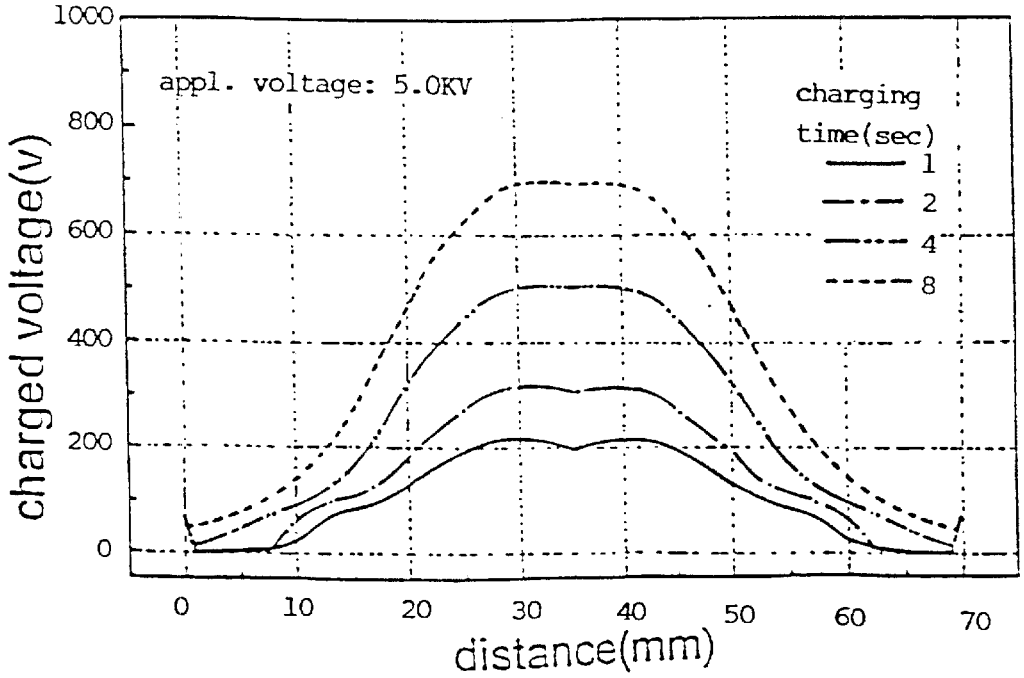
Figure 14:
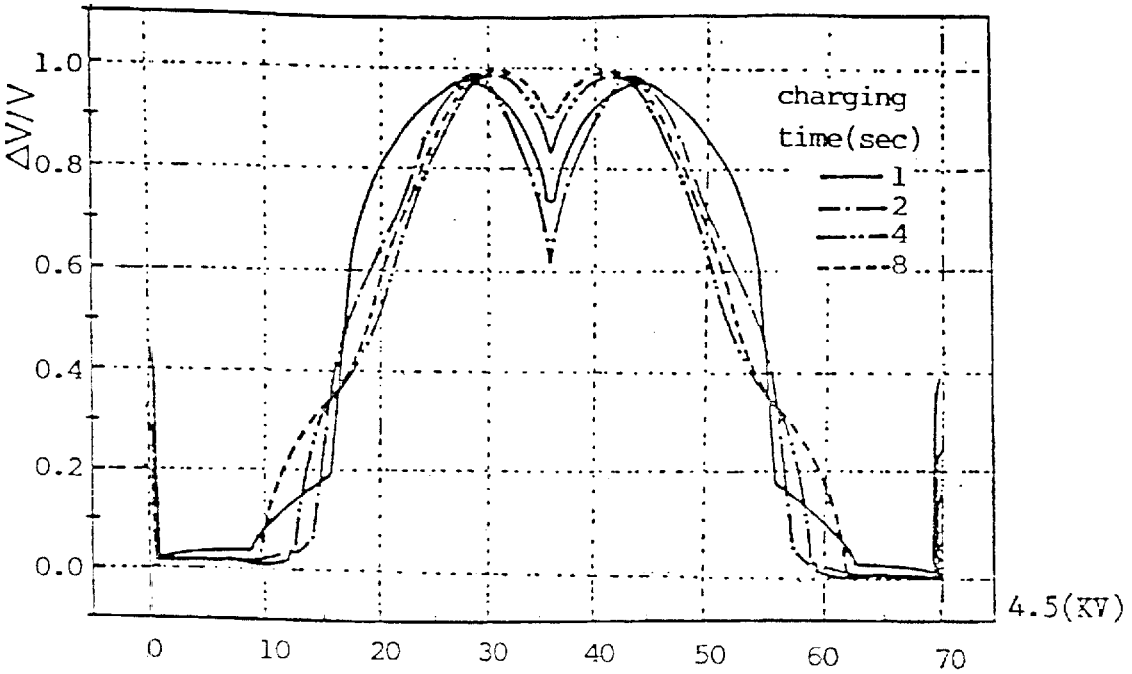
FIGS. 14 and 15 are graphs for showing the ratio of the voltage variances to the maximum voltages shown in FIGS. 12 and 13 under the same conditions as those in FIGS. 12 and 13.
Figure 15:
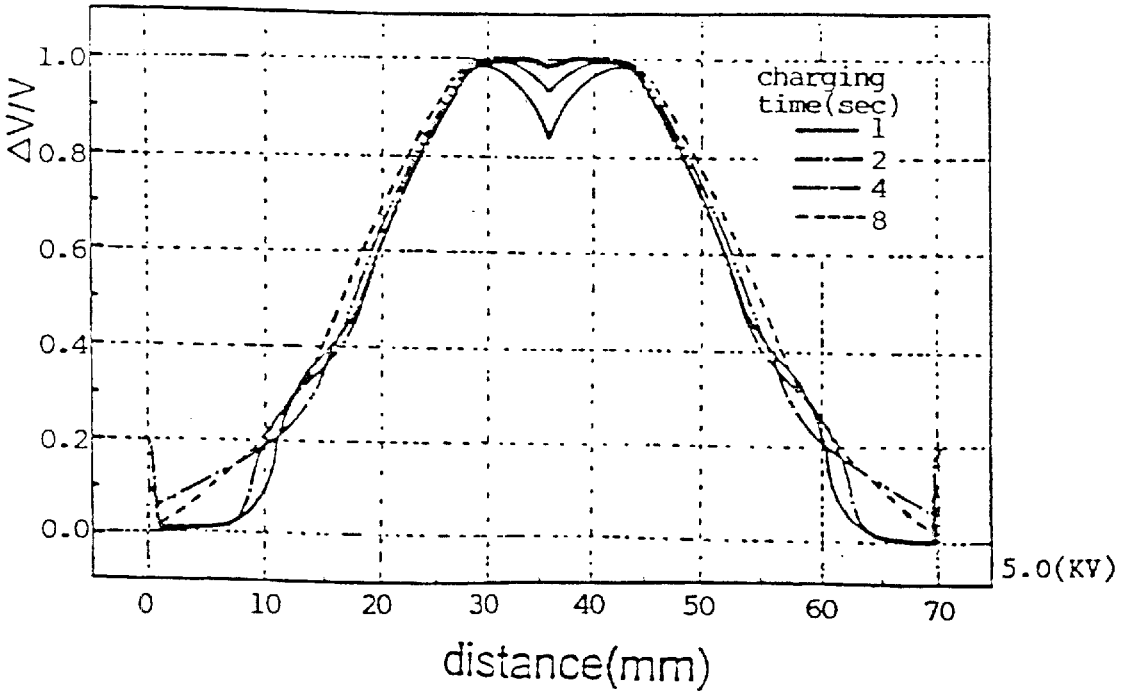
Figure 16:
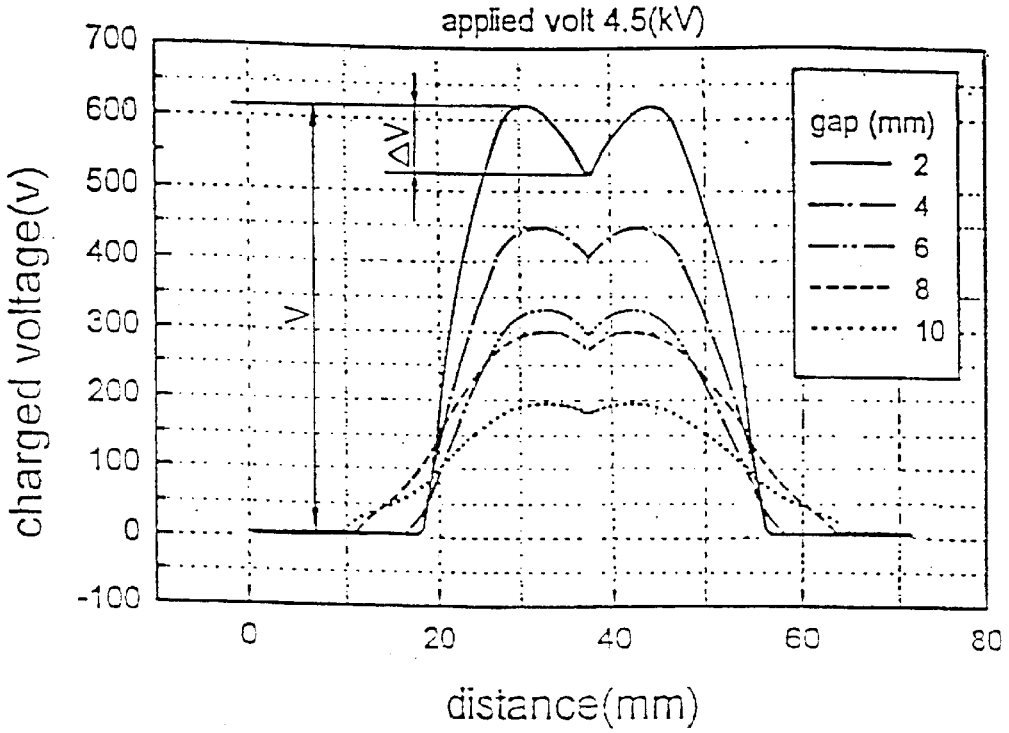
FIG. 16 is a graph for showing distributions of the charged voltages according to the distance with respect to various values of the charging gap between the ground electrodes and the photoconductive layer, when 4.5 KV is applied to the wire-type corona charger.
Figure 17:
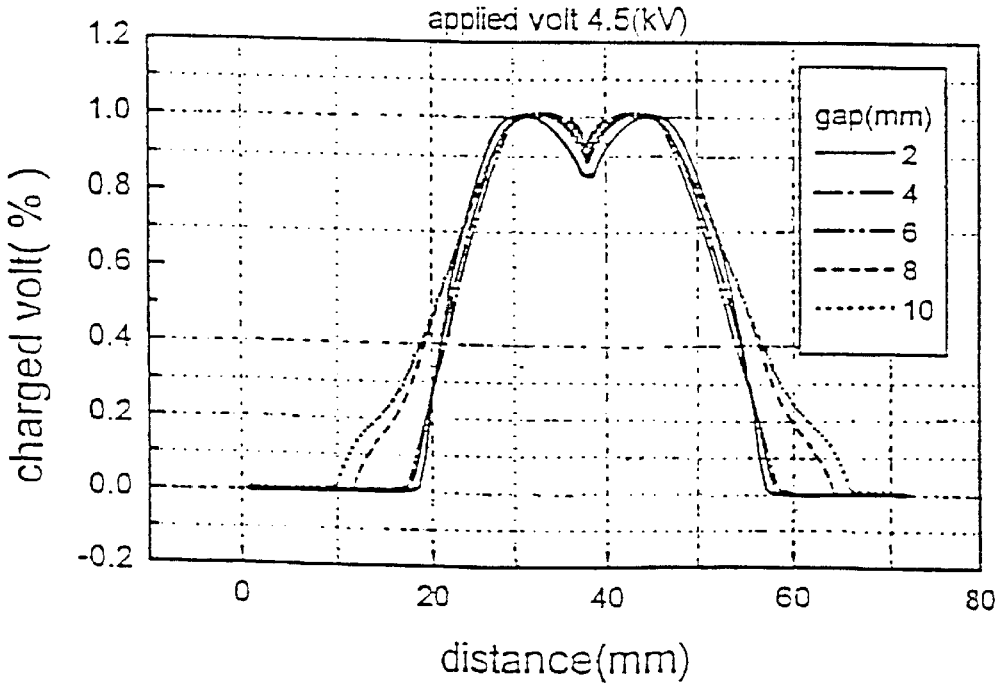
FIG. 17 is a graph for showing ratio of the voltage variances to the maximum voltages shown in FIG. 16 under the same conditions as those in FIG. 16.

FIGS. 12 to 17 show several results after the above-mentioned charging step performed by the wire-type corona charger 100 according to one embodiment of the present invention. FIGS. 12 and 13 are graphs for showing distributions of the charged voltages according to the distance with respect to several charging times, respectively when 4.5 KV and 5 DK are applied to the wire electrode 101. FIGS. 14 and 15 are graphs for showing ratio of the voltage variances to the maximum voltages shown in FIGS. 12 and 13 under the same conditions as those in FIGS. 12 and 13. FIG. 16 is a graph for showing distributions of the charged voltages according to the distance with respect to various values of the charging gap between the ground electrode plates 103 and the photoconductive layer 34, when 4.5 KV is applied to the wire electrode 101. FIG. 17 is a graph for showing ratio of the voltage variances to the maximum voltages shown in FIG. 16 under the same conditions as those in FIG. 16.

Throughout FIGS. 12 to 17, the maximum charged point is located at the positions of the wire electrode supporters 102 and 102'. Referring to FIGS. 12 to 15, in order to achieve uniform charging, it is necessary to be charged for about 8 seconds when the voltage applied to the wire electrode 101 is 4.5 KV, and only for 3 to 5 seconds when 5 KV, the charged voltage has substantially uniform value between 300 and 400 volt.

Referring to FIGS. 16 to 17, it is proper for the charging gap to be in the range from 4 to 9 mm in order to achieve uniform charging, when the voltage applied to the wire electrode 101 is 4.5 KV.

In general, cables for applying high voltage to the wire electrode 101 may be connected directly to the opposite ends of the wire electrode 101. However, it is preferred that the cable 110 may be fixedly inserted in a cable groove 105*a* formed in the insulating block 105 to prevent leakage of high voltage, as shown in FIG. 8.

FIGS. 8 and 9 show the cable groove 105*a* formed to be exposed on one side surface of the insulating block 105 in consideration of the thickness and manufacture of the insulating block 105. In this case, it is preferred that insulating plates 104 are located between the ground electrode plates 103 and the exposed side surfaces of the insulating block 105 as shown in FIGS. 6, 7, and 10, so as to prevent leakage of voltage from the cable 110 inserted in the cable groove 105*a*.

Figure 11:
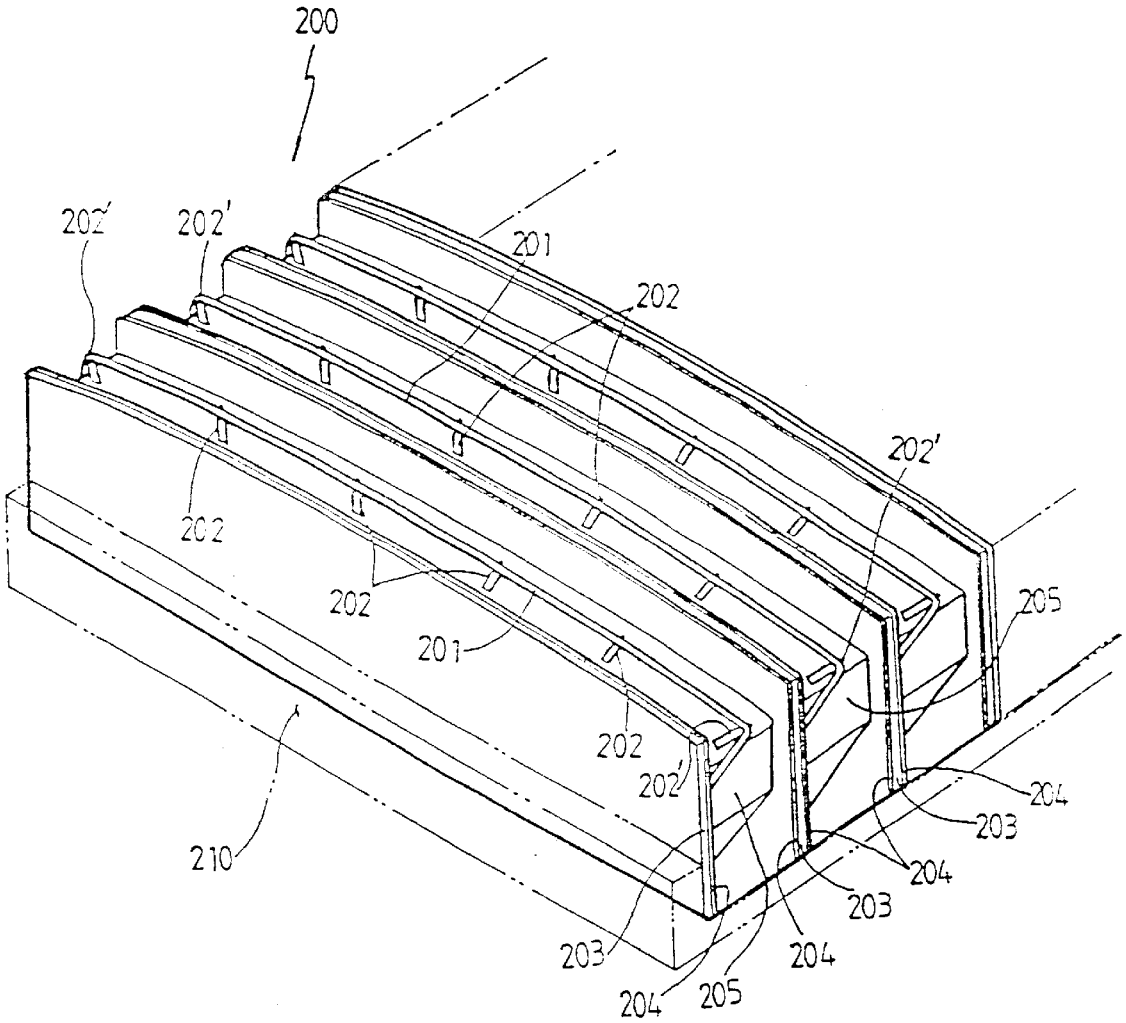
FIG. 11 is a perspective view of another wire-type corona charger for electrophotographically manufacturing a screen of a CRT according to another embodiment of the present invention.

FIG. 11 is a perspective view of a wire-type corona charger 200 for electrophotographically manufacturing a screen of a CRT according to another embodiment of the present invention.

The wire-type corona charger 200 includes at least three ground electrode plates 203, at least two insulating blocks 205, and at least two wire electrodes 201.

Similarly with the wire electrode 101 in FIG. 6, the wire electrodes 201 are supported by at least two sets of wire electrode supporters 202 and 202' arranged on the insulating blocks 205. Besides, not only the constructions and functions of the ground electrode plates 203, the insulating blocks 205, and the wire electrodes 201 but other conditions are similar to those in the previous embodiment.

The wire-type corona charger 200 having the above-described construction may be installed over the entire faceplate 18 as those in U.S. Pat. No. 5,519,217. Then, the wire-type corona charger 200 can uniformly charge the entire faceplate 18 when it travels a distance corresponding to a spacing between two adjacent wire electrodes 201. Therefore, the wire-type corona charger 200 can more rapidly perform the charging process in comparison with the wire-type corona charger 100. Moreover, though the wire-type corona charger 200 is not installed over the entire faceplate 18, a desired quantity of charges can be obtained even by low voltage because only one-time turning of the wire electrodes 201 corresponds to plural-time turnings of the wire-type corona charger 100 in FIG. 6. In addition, the quantity of charges at the periphery of the effective screen of the panel 12 can be regulated by changing the voltage applied to the wire electrodes 201.

Preferably, the wire electrode supporters 202 and 202' are arranged in a crossed alignment set by set. That is, the wire electrode supporters 202 and 202' are arranged in line along every other sets but not between adjacent sets, so as to maximize the charging uniformity by compensating the reduction of charges due to the leakage of charges through the wire electrode supporters 202 and 202'.

Hereinafter, described will be a method for electrophotographically manufacturing a screen of a CRT using the wire-type corona charger 100 shown in FIG. 6, referring again to FIG. 3.

The method comprises the steps of: (1) firstly coating an inner surface of the panel for form a volatile conductive layer 32 on the inner surface; (2) secondly coating the volatile conductive layer 32 with photoconductive solution to form a volatile photoconductive layer 34 on the volatile conductive layer 32, the photoconductive solution not contaminating the conductive layer 32; (3) charging at least effective surface of the volatile photoconductive layer 34 with uniform electrostatic charges by pivoting a corona charger along one of the curvatures of the horizontal axis and the vertical axis of an interior surface of the panel with intervals over the entire interior surface of the panel, the corona charger generating a corona discharge; (4) exposing the volatile photoconductive layer 34 through a shadow mask to a light according to a characteristic of the volatile photoconductive layer 34, so as to selectively discharge the electrostatic charges having been charged on the volatile photoconductive layer 34 in step 3; and (5) developing the photoconductive layer 34 by attaching powdered particles on one of an exposed area and an unexposed area of the photoconductive layer 34 after charging the powdered particles, the exposed area having been exposed to light in step 4 to lose the electrostatic charges.

The powdered particles may be one of the first to the third phosphor particles, and the steps 3 to 5 may be repeatedly performed with respect to the other particles. Also, the light-absorptive material of the black matrix may be formed as above, and in this case, the method further comprises, before the charging step 4, the steps of: charging the photoconductive layer 34 with uniform electrostatic charges by corona discharge in order to develop the light-absorptive material, exposing the photoconductive layer 34 through a shadow mask to a light according to a characteristic of the photoconductive layer 34, so as to selectively discharge the electrostatic charges charged on the photoconductive layer 34; and developing the photoconductive layer 34 by attaching light-absorptive material on one of an exposed area and a unexposed area of the photoconductive layer 34 after charging the light-absorptive material, the exposed area being exposed to light in the exposing step to lose the electrostatic charges. In this case, the light-absorptive material is formed in a predetermined matrix construction.

In the above charging step, the charging apparatus as disclosed in U.S. Pat. No. 5,132,188 or U.S. Pat. No. 5,519,217 may be employed. Further, the high voltage applied to the wire electrodes 101 and 201 may be increased in proportion to the increase of the gap between the photoconductive layer 34 and the wire electrode 101, the reduction of the thickness of the photoconductive layer 34, and the increase of the pivoting speed of the wire-type corona charger, to thereby enable to regulate the quantity of the electrostatic charges on the photoconductive layer 34 by the wire electrode 101 in the charging step. It is preferred for the following process that the photoconductive layer 34 is charged with uniform electrostatic charges between 300 and 400 volt. As is in the detailed description with reference to FIGS. 12 to 17, the gap between the ground electrode plates 103 and the photoconductive layer 34 is preferably more than 3 mm.

Also, the photoconductive layer 34 may include a material responsive to one of the visible rays and the ultraviolet rays in the secondly coating step, so that the photoconductive layer 34 is exposed to light of the visible rays or the ultraviolet rays according to the material of the photoconductive layer 34 in the exposing step. The solution for the photoconductive layer 34 responsive to the ultraviolet rays, for example, may contain: an electron donor material, such as about 0.01 to 10 percent by weight of bis-1,4-dimethyl phenyl (-1,4-diphenyl (butariene) or 2 to 5 percent by weight of tetrapheyl ethylene; an electron acceptor material, such as about 0.01 to 10 percent by weight of at least one of trinitro-fluorenone and ethyl anthraquinone; a macromolecular binder, such as 1 to 30 percent by weight polystyrene; and a solvent, such as the remaining percent by weight of toluene or xylene. This solution is further preferable because it does not require the dark environment for the exposing step.

Figure 1:
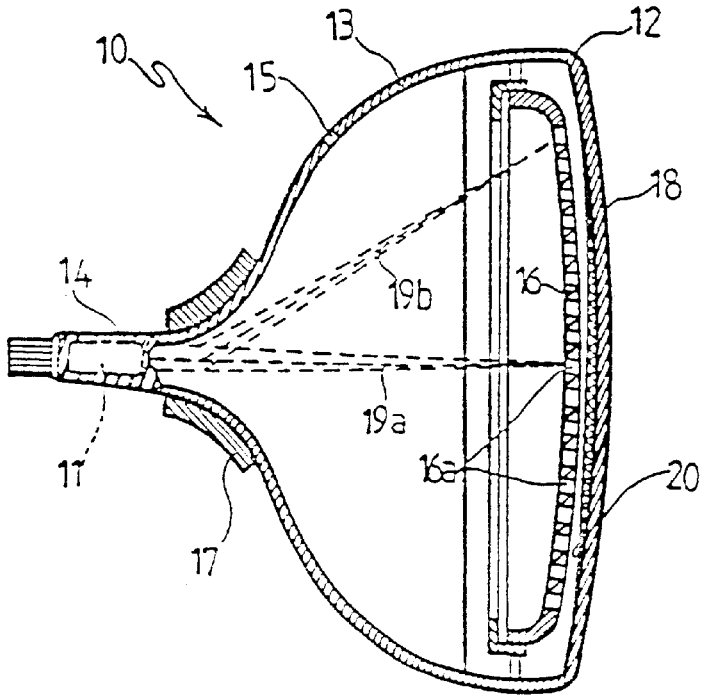
FIG. 1 is a plan view partially in axial section of a color cathode-ray tube.
Figure 2:
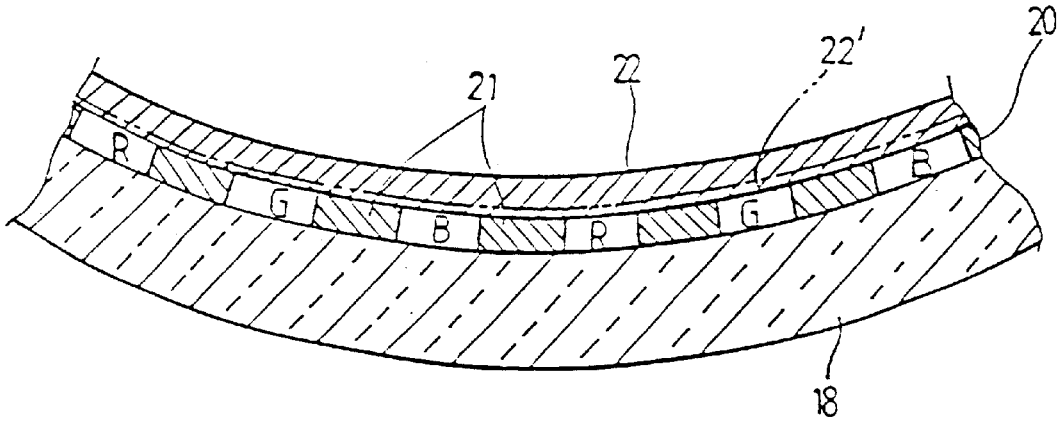
FIG. 2 is a section of a screen assembly of the tube shown in FIG. 1.
Figures 3A, 3B, 3C, 3D, 3E:
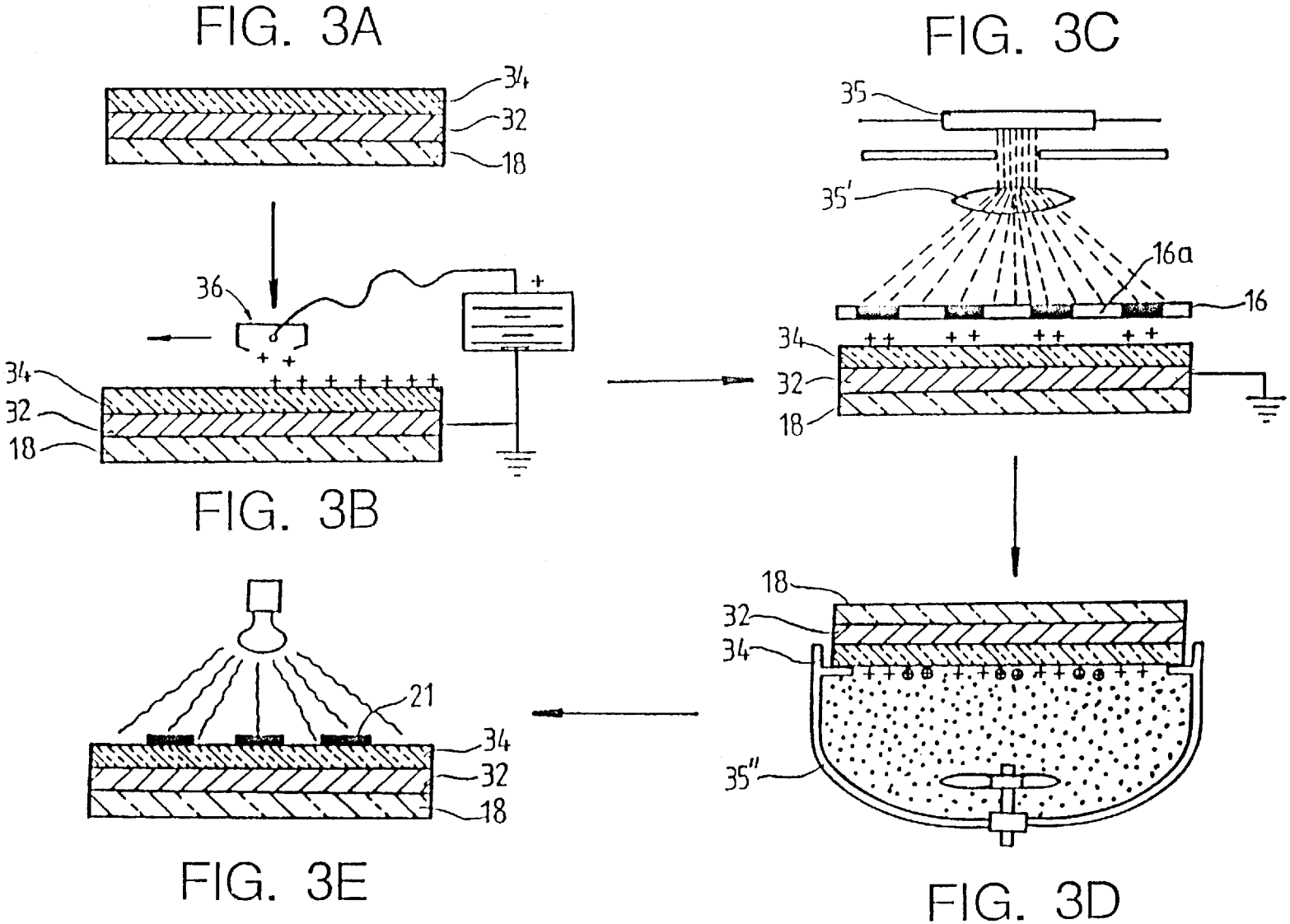
FIGS. 3A through 3E are schematic sectional views for showing various steps in electro-photographically manufacturing the screen assembly of the tube according to the prior art, in which a portion of a faceplate having a conductive layer and an overlying photoconductive layer together with devices used in each step is shown.

Moreover, in the developing step, instead of being charged by the contact as shown in FIG. 3D, the powdered particles may be charged by a contact with a pipe in the course of being supplied, or charged by a corona discharge just before being sprayed by a spray coater.

The fixing step as shown in FIG. 3E may employ a vapor swelling method wherein the fixing is performed by a contact with a solvent vapor such as acetone and methyl isobutyl ketone, or a spraying method wherein an electrostatic solution spray gun sprays a mixture of at two kinds among methyl isobutyl ketone, TCE, toluene, and xylene of the petrolium group on the developed powdered-particles of red, green, and blue. Otherwise, the fixing step may omitted partly or totally.

In addition, the pivoting speed of the charger and the voltage-applying time and the applied voltage to each wire electrode may be variable independently to or in combination with each other, so as to charge the entire effective screen of the panel faceplate 18 to a uniform predetermined voltage. That is, the wire electrodes 101 and 201 as shown in FIGS. 6 and 11 may be pivoted slowly at the periphery of the screen, or the charging time at the wire electrodes may be gradually prolonged as it goes inward from those at the sides, at the beginning and closing of the charging step. Further, the voltage applied to the wire electrodes may be changed from the higher voltage than to the same voltage as that applied to the other wire electrodes, so that the periphery of the faceplate may be charged equally to the other parts thereof.

As apparent from the above description of the construction and function of the wire-type corona charger and the method for electrophotographically manufacturing a screen of a CRT using the wire-type corona charger according to several embodiments of the present invention, the wire-type corona charger for electrophotographically manufacturing a screen of a CRT is achieved basically by means of the wire electrodes 101 and 201 and the wire electrode supporters 102 and 102', wherein the wire electrodes 101 and 201 enables more rapid and uniform charging of the photoconductive layer in the charging step of the process for electrophotographically manufacturing a screen of a CRT. The present invention further enables a uniform exposure and development in the above exposing and developing steps, thereby not only improving the productivity and quality of the CRT but also increasing the charging efficiency.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A wire-type corona charger for electrophotographically manufacturing a screen of a CRT, the wire-type corona charger being installed in a corona discharge apparatus and pivoted with a spacing over an entire interior surface of a panel faceplate of the screen along a first curvature which is one of curvatures of a horizontal axis and a vertical axis of the interior surface of the panel faceplate, so as to uniformly charge at least effective surface of a photoconductive layer with a desired voltage, the photoconductive layer being formed on an electro-conductive layer formed on the interior surface of the panel faceplate, the wire-type corona charger comprising:

a pair of ground electrode plates each of which has arcuately-shaped upper edge with a curvature substantially equal to a second curvature, the second curvature being a remaining one of the curvatures of the horizontal axis and the vertical axis of the interior surface of the panel faceplate, the pair of ground electrode plates being grounded with being arranged in parallel and spaced with regular intervals apart;

an insulating block disposed between the pair of the ground electrode plates and made from electrically insulating material, the insulating block having a plurality of wire electrode supporters so arranged that their upper ends are arranged to have a curvature substantially equal to the second curvature and lower than upper edges of the pair of ground electrode plates; and a wire electrode being supported by the upper ends of the plurality of wire electrode supporters, to which a high voltage is applied, so that at least effective screen of the photoconductive layer is charged uniformly.

2. A wire-type corona charger as claimed in claim 1, wherein the upper ends of the wire electrode supporters are formed sharply, so that their sections in a direction of the second curvature respectively have an inverted V-shape, so as to minimize a contact area between the wire electrode and the wire electrode supporters, thereby minimizing leakage of high voltage.

3. A wire-type corona charger as claimed in claim 1, further comprising tension-applying means for applying tension to the wire electrode, so as to generate a uniform corona discharge along an entire length of the wire electrode.

4. A wire-type corona charger as claimed in claim 3, wherein the tension-applying means are located at either ends of the insulating block and formed integrally with opposite ends of the wire electrode, further comprising a pair of tension-support means each of which supports the wire electrode at either points between the tension-applying means and the wire electrode supporters disposed at either ends thereof, so that a constant tension is continuously applied to the wire electrode along its entire length after the wire electrode is installed.

5. A wire-type corona charger as claimed in claim 1, wherein end supporters among the wire electrode supporters, which are disposed at the opposite ends, support the wire electrode in such a manner that even peripheral portions of an effective screen of the panel faceplate can be uniformly charged.

6. A wire-type corona charger as claimed in claim 1, wherein the wire electrode supporters are fixedly inserted in a supporter recess formed on an upper surface of the insulating block.

7. A wire-type corona charger as claimed in claim 6, wherein a upper surface of the insulating block is formed to have a curvature substantially equal to the second curvature, and interior supporters of the wire electrode supporters extend in normal direction with respect to the curvature of the upper surface of the insulating block, while end supporters of the wire electrode supporters extend to be open as widely as possible outward from the normal directions, the end supporters being disposed at the opposite ends of the wire electrode supporters and the interior supporters being the remaining wire electrode supporters excepting from the end supporters.

8. A wire-type corona charger as claimed in claim 1, wherein the wire electrode is made of tungsten plated with gold.

9. A wire-type corona charger as claimed in claim 1, wherein the wire electrode is located at a center of a gap(W) between the ground electrode plates with being lower than the arcuately-shaped upper edge of the ground electrode plates by a depth H corresponding to a half of the gap.

10. A wire-type corona charger as claimed in claim 1, wherein the insulating block and the pair of ground electrode plates may be detachably assembled by assembling means through holes thereof, the hole(s) in one of the insulating block and the pair of ground electrode plates being slotted so as to adjust a relative position of the wire electrode and the arcuately-shaped upper edge of the ground electrode plates.

11. A wire-type corona charger as claimed in claim 1, wherein a cable for applying a high voltage to the wire electrode is fixedly inserted in a cable groove formed in one of two exposed side surfaces of the insulating block, and at least one insulating plate is located between the ground electrode plate disposed on the one exposed side surface and the one exposed side surface of the insulating block to cover the cable groove, so as to prevent leakage of voltage from the cable to the ground electrode plates.

12. A wire-type corona charger as claimed in claim 1, wherein the interior surface of the panel faceplate is aspheric, and the second curvature has a longer radius than the first curvature.

13. A wire-type corona charger as claimed in claim 1, wherein the insulating block is inserted in and formed integrally with the ground electrode plates without separate fixing means.

14. A wire-type corona charger as claimed in claim 1, wherein the ground electrode plates comprise a base in a body, and the insulating block is inserted onto the base and then fixed by a fixing means including adhesives, and the insulating block is formed integrally with the base and the ground electrode plates by molding.

15. A wire-type corona charger for electrophotographically manufacturing a screen of a CRT, the wire-type corona charger being installed in a corona discharge apparatus and pivoted to a predetermined distance along a first curvature which is one of curvatures of a horizontal axis and a vertical axis of the interior surface of the panel faceplate, so as to uniformly charge at least effective surface of a photoconductive layer with a desired voltage, the photoconductive layer being formed on an electro-conductive layer formed on the interior surface of the panel faceplate, the wire-type corona charger being pivoted with a spacing from the photoconductive layer, the wire-type corona charger comprising:

at least three ground electrode plates, each of which has arcuately-shaped upper edge with a curvature substantially equal to a second curvature, the second curvature being a remaining one of the curvatures of the horizontal axis and the vertical axis of the interior surface of the panel faceplate at each section of the panel faceplate nearest to each of the ground electrodes, the pair of ground electrode plates being grounded with being arranged in parallel and spaced with regular intervals apart;

at least two sets of insulating blocks each of which is disposed respectively between the ground electrode plates and made from electrically insulating material, each of the insulating blocks having a plurality of wire electrode supporters so arranged that their upper ends are arranged to have a curvature substantially equal to the second curvature; and at least two wire electrodes being supported by the upper ends of the wire electrode supporters, to which a high voltage is applied, so that at least effective screen of the photoconductive layer is charged uniformly.

16. A wire-type corona charger as claimed in claim 15, wherein the wire electrode supporters are arranged in a crossed alignment set by set.

17. A wire-type corona charger as claimed in claim 15, wherein the wire electrodes are installed over the entire faceplate and pivoted with a distance corresponding to a gap between two adjacent wire electrodes, thereby uniformly charging the entire faceplate.

18. A wire-type corona charger as claimed in claim 15, wherein the upper ends of the wire electrode supporters are formed sharply, so that their sections in a direction of the second curvature respectively have an inverted V-shape, so as to minimize a contact area between the wire electrodes and the wire electrode supporters, thereby minimizing leakage of high voltage.

19. A wire-type corona charger as claimed in claim 15, further comprising tension-applying means for applying tension to the wire electrodes, so as to generate a uniform corona discharge along entire lengths of the wire electrodes.

20. A wire-type corona charger as claimed in claim 19, wherein the tension-applying means are located at either ends of each of the insulting block and formed integrally with opposite ends of each of the wire electrode, each set of insulating blocks further comprising a pair of tension-support means each of which supports the wire electrode at either points between the tension-applying means and the wire electrode supporters disposed at either ends thereof, so that a constant tension is continuously applied to each of the wire electrodes along its entire length after each of the wire electrodes is installed.

21. A wire-type corona charger as claimed in claim 15, wherein end supporters of the wire electrode supporters, which are disposed at the opposite ends, support the wire electrode in such a manner that even peripheral portions of an effective screen of the panel faceplate can be uniformly charged.

22. A wire-type corona charger as claimed in claim 15, wherein the wire electrode supporters are fixedly inserted in supporter recesses formed on upper surfaces of the insulating blocks.

23. A wire-type corona charger as claimed in claim 22, wherein an upper surface of each of the insulating blocks is formed to have a curvature substantially equal to the second curvature, and interior supporters of the wire electrode supporters extend in normal directions with respect the curvature of the upper surface of each of the insulating blocks, while end supporters of the wire electrode supporters extend to be open as widely as possible outward from the normal directions, the end supporters being disposed at the opposite ends of the wire electrode supporters and the interior supporters being the remaining wire electrode supporters excepting from the end supporters.

24. A wire-type corona charger as claimed in claim 15, wherein the wire electrodes are made of tungsten plated with gold.

25. A wire-type corona charger as claimed in claim 15, wherein each of the wire electrodes is located at a center of a gap between two adjacent ones of the ground electrode plates with being lower than the arcuately-shaped upper edge of said two adjacent ones by a depth H corresponding to a half of the gap.

26. A wire-type corona charger as claimed in claim 15, wherein a cable for applying a high voltage to each of the wire electrodes is fixedly inserted in a cable groove formed respectively in one of two exposed side surfaces of each of the insulating blocks, and at least one insulating plate is located between the ground electrode plate disposed on the one exposed side surface and the one exposed side surface of each of the insulating blocks to cover each of the cable grooves, so as to prevent leakage of voltage from the cable to the ground electrode plates.

* * * * *